US005575213A

United States Patent [19]

Kawai et al.

[11] Patent Number: 5,575,213

[45] Date of Patent: Nov. 19, 1996

[54] FEEDING UNIT

[75] Inventors: Muneaki Kawai; Terutoshi Nakao, both of Tokyo, Japan

[73] Assignee: Riso Kagaku Corporation, Tokyo, Japan

[21] Appl. No.: 550,864

[22] Filed: Oct. 31, 1995

[30] Foreign Application Priority Data

Nov. 18, 1994 [JP] Japan ..... 6-285157

[51] Int. Cl.[6] ..... B41F 27/06

[52] U.S. Cl. ..... 101/477; 101/118; 101/408

[58] Field of Search ..... 101/118, DIG. 36, 101/408, 415.1, 477, 389.1

[56] References Cited

U.S. PATENT DOCUMENTS

| | | | |
|---|---|---|---|
| 2,374,668 | 5/1945 | Davidson | 101/408 |
| 3,852,980 | 12/1974 | Zimmer | 101/118 |
| 4,237,466 | 12/1980 | Scranton | 101/389.1 |
| 4,238,999 | 12/1980 | Giani et al. | 101/118 |
| 4,846,057 | 7/1989 | Endo et al. | 101/477 |
| 5,053,826 | 10/1991 | Castelli et al. | 101/408 |
| 5,160,944 | 11/1992 | Fukumoto et al. | 101/408 |

*Primary Examiner*—Eugene H. Eickholt

*Attorney, Agent, or Firm*—Sughrue, Mion, Zinn, Macpeak & Seas

[57] ABSTRACT

A stencil discharging unit of a rotary stencil printing machine has a feeding unit and a stencil discharging container. The feeding unit has a first feeding means and a second feeding means. The first feeding means that is on the upper side includes groups of pulleys and groups of belts. The second feeding means that is on the lower side includes groups of pulleys and groups of belts. The pulleys in each group are pitched at a predetermined interval in an axial direction. The respective pulleys are supported by support members that are independent of one another. Each support member is mounted on a plate member that has bending resiliency. Springs urge the plate member upward. With the plate member bent, the respective pulleys are displaced independently of one another.

10 Claims, 4 Drawing Sheets

FEEDING UNIT

BACKGROUND OF THE INVENTION

1. Field of the Invention

The invention relates to a feeding unit having a forwarding mechanism in which belts are installed around a plurality of pulleys. More specifically, the invention relates to, for instance, a feeding unit for forwarding consumed stencil paper to a predetermined scrapping position in stencil printing machines and the like.

2. Description of Related Art

A rotary stencil printing machine has a cylindrical drum that is driven to rotate about a shaft center thereof. At least a part of the circumferential wall of the cylindrical drum is used as a printing region through which ink can pass. An ink supply means for supplying the ink into the inner surface of the circumferential wall is provided inside the cylindrical drum. A perforated stencil paper for performing the stencil printing is wound around the outer circumfernetial surface of the cylindrical drum. A printing sheet fed as the cylindrical drum rotates is pressed onto the cylindrical drum by pressing means arranged on the outer side of the cylindrical drum. The ink is introduced into the printing sheet through an image formed on the perforated stencil paper wound around the cylindrical drum, so that the stencil printing can be performed on the printing sheet.

The aforementioned stencil printing machine includes: a stencil discharging container that contains a consumed stencil paper; and a feeding unit that forwards the consumed stencil paper to the stencil discharging container. Some feeding units employ a feeding mechanism that includes pulleys and belts.

That is, a plurality of pulleys are pitched at a predetermined interval on each of two parallel running rotary shafts, and belts are installed around the pulleys of one rotary shaft and those of the other rotary shaft, respectively. The thus constructed feeding means are arranged so as to confront each other up and down. By rotating both feeding means in directions opposite to each other, a consumed stencil paper is fed while nipped by the belts of the upper and lower feeding means.

A conventional feeding unit employed in the stencil printing machine can forward a consumed stencil paper without any problem as long as the thickness of the stencil paper is uniform. If the consumed stencil paper is partially folded and has the folds bonded to each other by the ink, then the thickness of the stencil paper may, in some cases, becomes ununiform in a width direction that is orthogonal to a stencil paper forwarding direction. In such cases, the belts of the feeding unit do not come in contact with the thinner portion of the stencil paper adequately, which prevents the stencil paper from being forwarded in the correct condition, causing the stencil paper to jam along the forwarding path.

SUMMARY OF THE INVENTION

The invention has been made in view of the aforementioned problem. The object of the invention is, therefore, to provide a feeding unit capable of forwarding a sheetlike body such as a stencil paper correctly even if the thickness of such sheetlike body becomes ununiform.

According to a first aspect of the invention, a feeding unit comprises: first feeding means including, a plurality of pulleys arranged to confront one another, each having an axis and being rotatable around the axis, and a belt installed around the pulleys, wherein a set is defined by the pulleys and the belt therearound, and a plurality of sets are provided and juxtaposed along pulley's axial directions; second feeding means including, a plurality of pulleys arranged to confront one another, each having an axis and being rotatable around the axis, and a belt installed around the pulleys, wherein a set is defined by the pulleys and the belt therearound, a plurality of sets are provided and juxtaposed along pulley's axial directions, the pulleys of the second feeding means are located at the corresponding position to the respective pulleys of the first feeding means; and support means for urging the respective pulleys belonging to at least a single pulley group, the single pulley group being defined by the pulleys arranged along a common axis in either one of the first feeding means and the second feeding means, toward confronting the other one of the first feeding means and the second feeding means with a predetermined force independently from the other pulleys belonging to the same single pulley group.

According to a second aspect, a feeding unit of the first aspect, wherein the support means includes: a plurality of support members for rotatably supporting a plurality of pulleys arranged along one of common axis; a plate member to which the support members are attached, the plate member having bending resiliency; a support portion for supporting the plate member so as to keep the bending resiliency of the plate member; and urging means for urging the plate member wherein the pulleys arranged along the one of the common axis come in contact with the corresponding pulleys belonging to the confronting feeding means.

According to a third aspect, a feeding unit of the second aspect, wherein a notch is formed at least one of positions, each position being between mounting portions of the support members.

At least the pulleys belonging to one group of pulleys in one of the feeding means are supported by the support means independently of one another and are urged towards the corresponding pulleys of the other feeding means. Even if the thickness of a screen printing stencil paper becomes ununiform across the width in the case of forwarding a screen printing stencil paper, the respective pulleys juxtaposed in the axial direction can nip the screen printing stencil paper with respect to the confronting pulleys under a uniform pressure. The single-sided contact of the screen printing stencil paper with the pulleys can be prevented, which in turn allows the screen printing stencil paper to be forwarded correctly.

DETAILED DESCRIPTION OF THE PREFERRED EMBODIMENTS

A rotary stencil printing machine, which is a first embodiment of the invention, will now be described with reference to FIGS. 1 to 5.

This rotary stencil printing machine includes a feeding unit of the invention as a feeding mechanism in the stencil discharging unit. The rotary stencil printing machine 1 has a cylindrical drum 2, which is cylindrical in shape. The cylindrical drum 2 is driven by drive means (not shown) and rotates in the counterclockwise direction about the central shaft line thereof as viewed in FIG. 1. A printing region through which ink passes and a non-printing region through which the ink does not pass are formed over the circumferential wall of the cylindrical drum 2. Within the cylindrical drum 2 is an ink supply means (not shown) that supplies the ink into the inner surface of the circumferential wall. A locking unit 3 is provided on the outer circumferential surface of the non-printing region on the cylindrical drum 2. The locking unit 3 holds the leading end of a screen printing stencil paper wound around the cylindrical drum 2.

Figure 1:
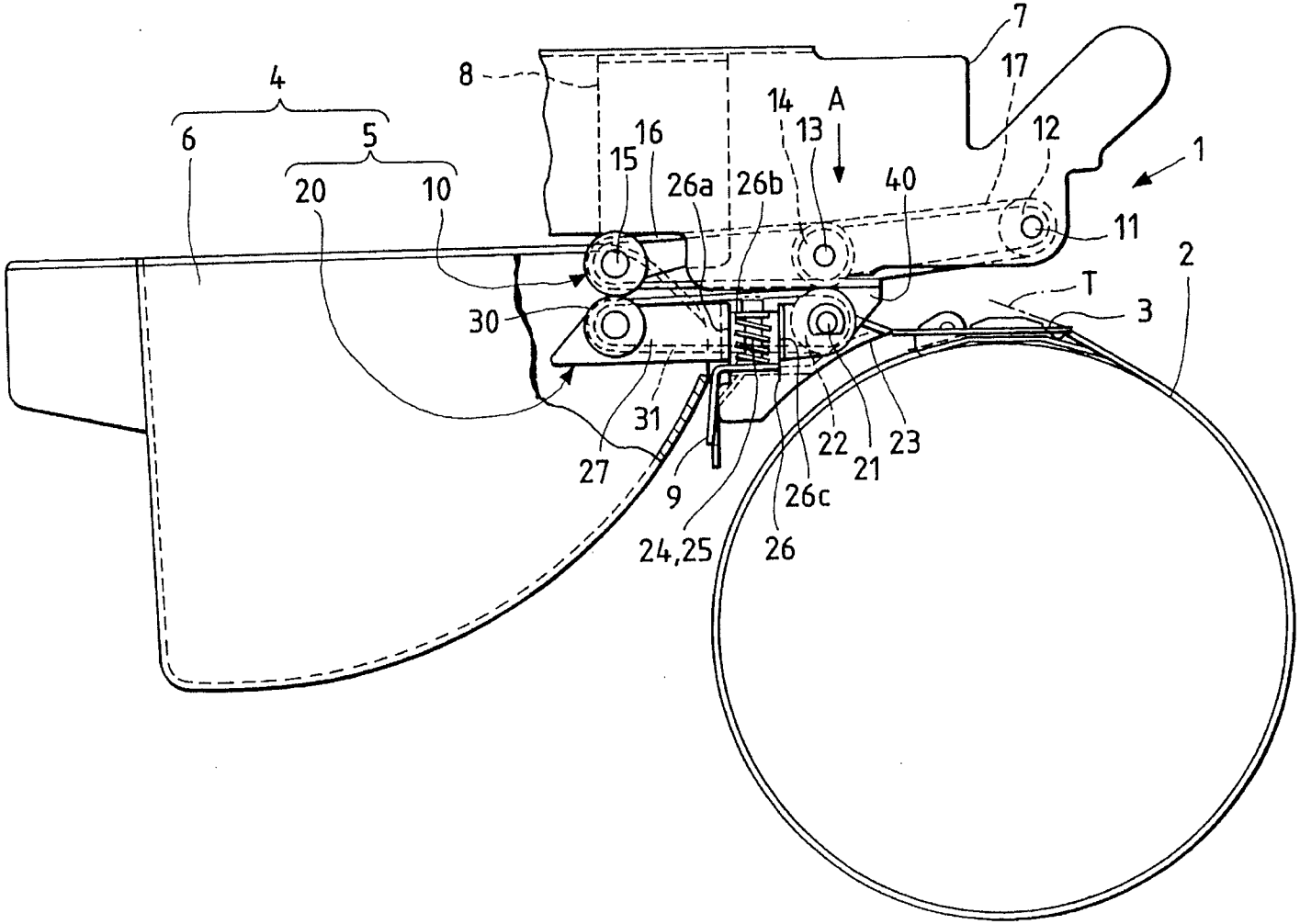
FIG. 1 is a side view of a first embodiment of the invention.

As shown in FIG. 1, the stencil discharging unit 4 is arranged on the left side of the cylindrical drum 2. The stencil discharging unit 4 scraps the consumed stencil paper by peeling the stencil paper off the outer circumferential surface of the cylindrical drum 2. The stencil discharging unit 4 has a feeding unit 5 and a stencil discharging container 6 that contains the consumed stencil paper that is forwarded by the feeding unit 5.

The feeding unit 5 includes first and second feeding means 10, 20, each including a plurality of belts and a plurality of pulleys. As shown in FIG. 1, the first feeding means 10 is mounted on an opening/closing plate 7 arranged above the cylindrical drum 2. The opening/closing plate 7 serves as a cover body constituting the upper surface of a frame body (not shown) in the rotary stencil printing machine 1, and has the left end portion thereof not shown in FIG. 1 rotatably coupled to the frame body.

As shown in FIG. 1, a first upper rotary shaft 11 is rotatably arranged on the right end of the opening/closing plate 7. The first upper rotary shaft 11 runs in parallel with the central shaft line of the cylindrical drum 2. Four first upper pulleys 12 are pitched at a predetermined interval along the first upper rotary shaft 11.

A second upper rotary shaft 13 is rotatably arranged next to the first upper rotary shaft 11 in the consumed stencil paper discharging direction (to the left as viewed in FIG. 1). The second upper rotary shaft 13 runs in parallel with the first upper rotary shaft 11. Four second upper pulleys 14 are pitched at a predetermined interval along the second upper rotary shaft 13. Each second upper pulley 14 has two rows of grooves, so that two belts can be installed.

Four third upper pulleys 15 are pitched at a predetermined interval next to the second upper rotary shaft 13 in the consumed stencil paper discharging direction (to the left as viewed in FIG. 1). The third upper pulleys 15 are mounted on a plurality of support plates 8 that are fixed to the opening/closing plate 7 so that the pulleys 15 can rotate about the shaft lines thereof. The respective shaft lines of the third upper pulleys 15 run in parallel with the first upper rotary shaft 11 and the second upper rotary shaft 13. It may be noted that the support plates 8 for rotatably supporting the third upper pulleys 15 are not shown in FIG. 2.

Figure 2:
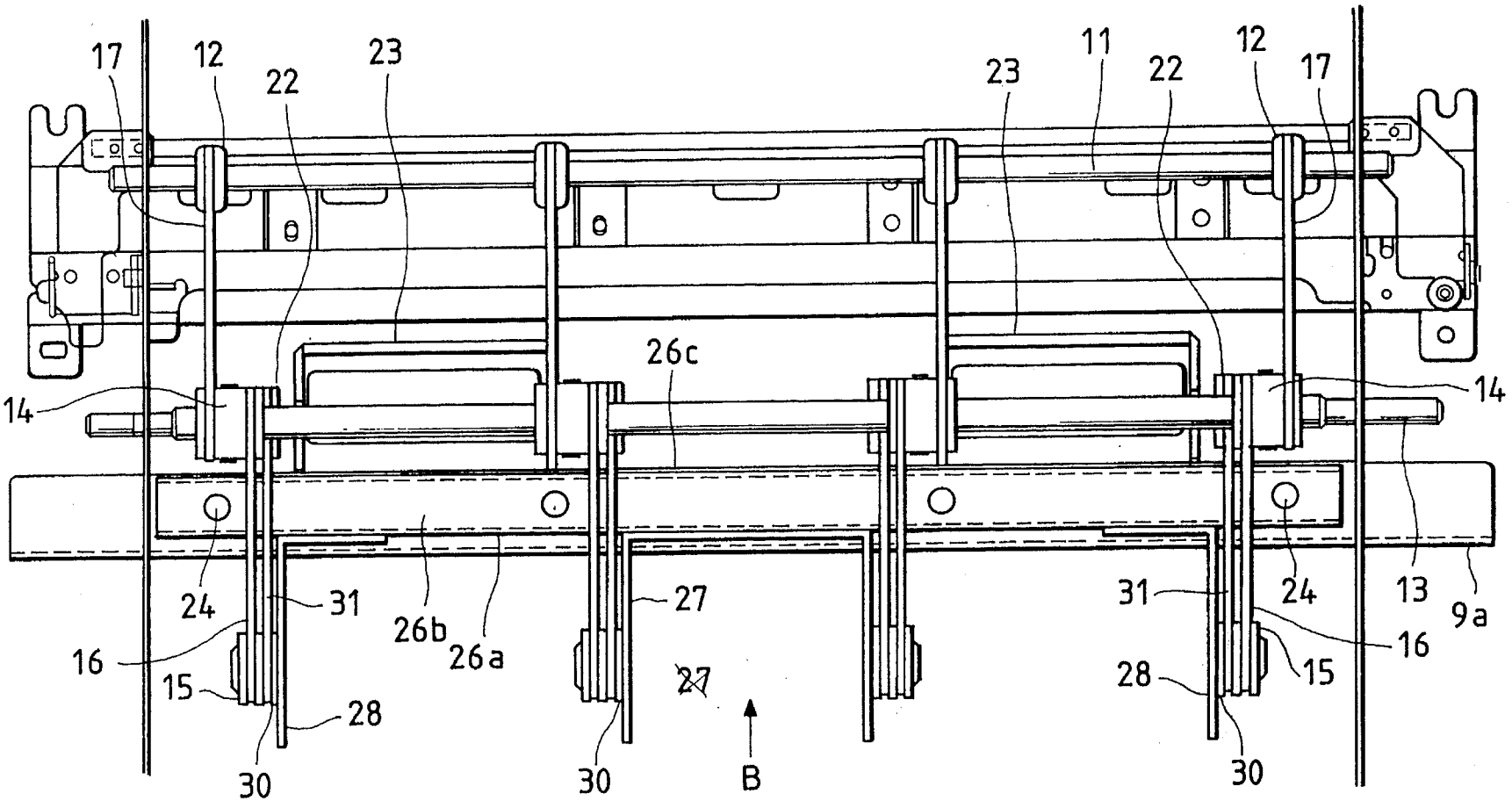
FIG. 2 is a partial view in a direction indicated by an arrow A in FIG. 1.

As shown in FIGS. 1 and 2, belts 16 are installed around the third upper pulleys 15 and the second upper pulleys 14 whose positions in the axial direction correspond to each other, respectively. Belts 17 are installed around the second upper pulleys 14 and the first upper pulleys 12 whose positions in the axial direction correspond to each other, respectively. When the second upper rotary shaft 13 is driven, the first upper pulleys 12, the second upper pulleys 14, and the third upper pulleys 15 are rotated in the same direction, and so do the belts 16, 17 in the same direction in circulation. In FIG. 1, the respective pulleys 12, 14, 15 and the respective belts 16, 17 rotate in the clockwise direction.

Figure 3:
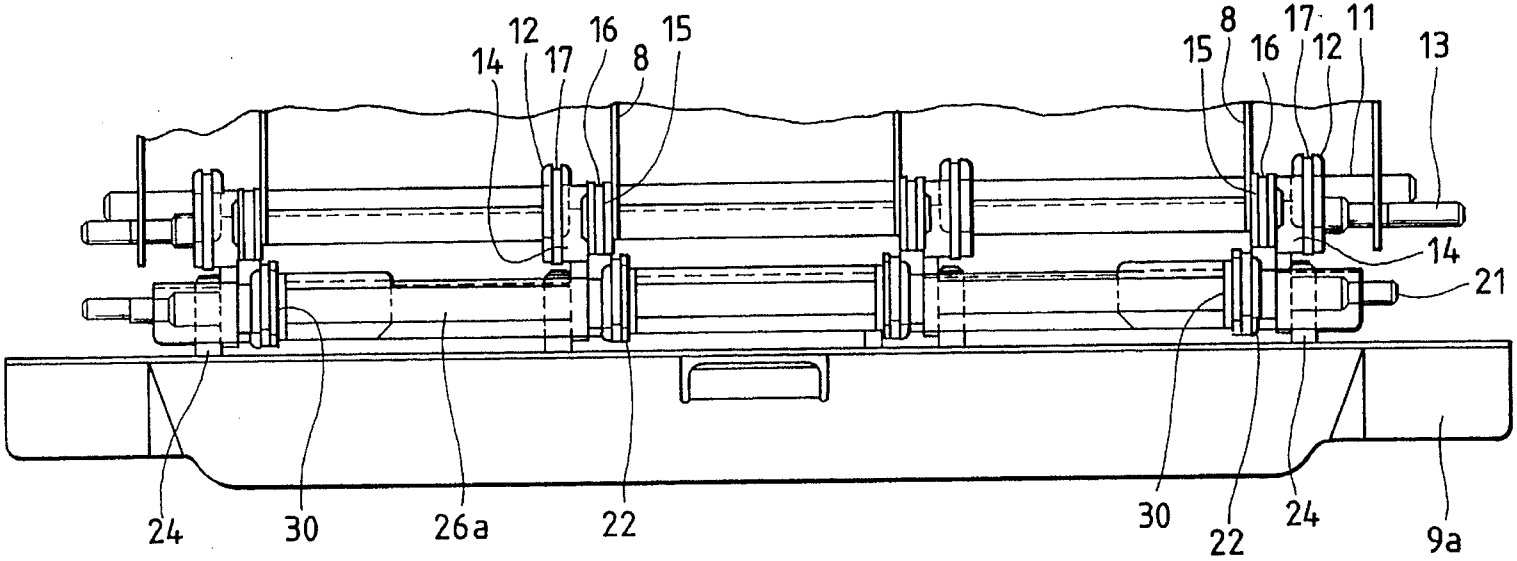
FIG. 3 is a partial view in a direction indicated by an arrow B in FIG. 2.

As shown in FIG. 1, the second feeding means 20 is placed on a structural body (fixed portion) 9 of the rotary stencil printing machine 1 under the first feeding means 10. As shown in FIG. 3, a first lower rotary shaft 21 is rotatably arranged above the structural body 9. The first lower rotary shaft 21 runs in parallel with the second upper rotary Shaft 13, and is arranged right under the second upper rotary shaft 13. Four first lower pulleys 22 are pitched at a predetermined interval along the first lower rotary shaft 21. The first lower pulleys 22 are positioned so as to nearly come in contact with the second upper pulleys 14, respectively.

Figure 5:
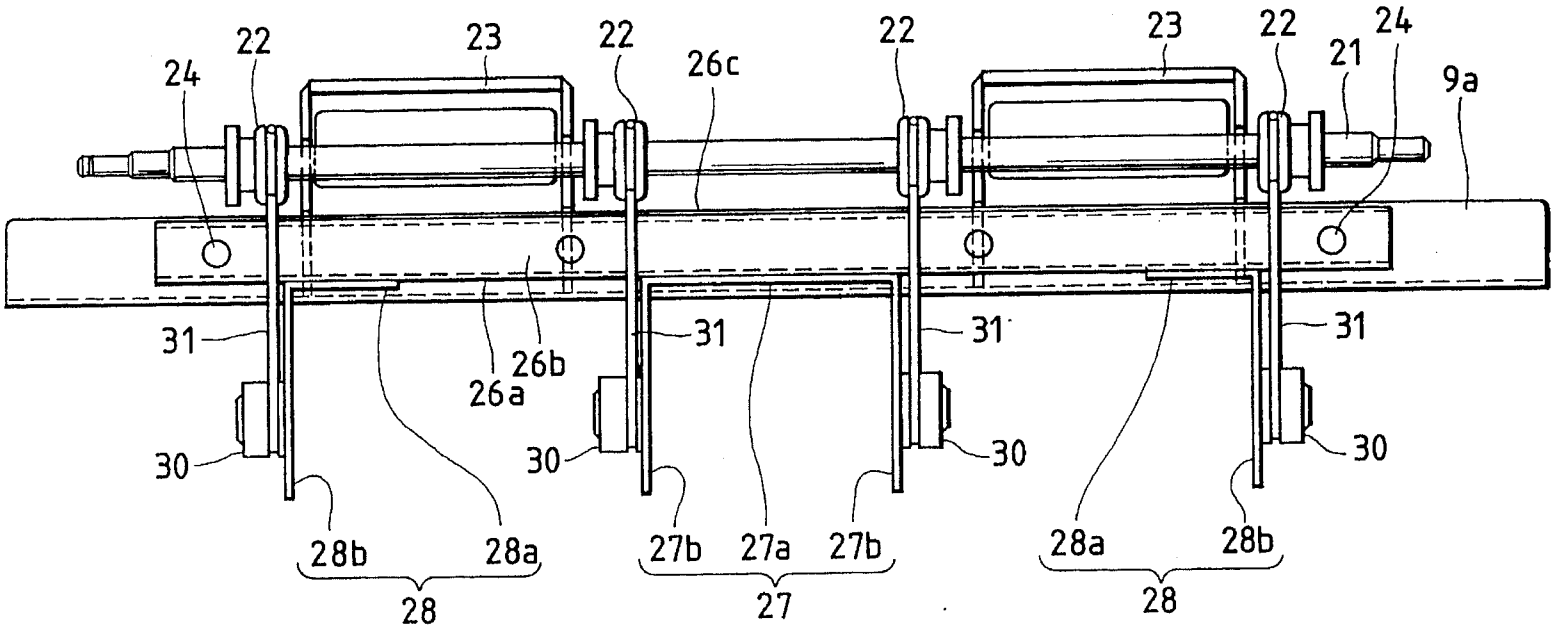
FIG. 5 shows a first feeding means 10 as viewed in the direction indicated by the arrow A in FIG. 1.

As shown in FIGS. 1, 2, and 5, two separating pawls 23 are arranged below the first lower rotary shaft 21. These two separating pawls 23 are fixed to the structural body 9, each having a wedgelike end which orients toward the top of the cylindrical drum 2. When the locking unit 3 is released, the leading end of the stencil paper wrapped around the cylindrical drum 2 becomes free. When the cylindrical drum 2 then rotates, the leading end of the stencil paper is guided to the two separating pawls 23 to be threaded between the first feeding means 10 and the second feeding means 20.

The first lower rotary shaft 21 is rotatably supported by a support member 40 that is fixed to a side plate **26*c* of the plate member 26 on the structural body 9. The structural body 9 is substantially L-shaped in cross-section and runs in parallel with the first lower rotary shaft 21. The structural body 9 is fixed to a main body (not shown) of the stencil printing machine. As shown in FIGS. 1 to 3, four rodlike columns 24 are fixed at an interval on the upper surface of the structural body 9. A coil spring 25, which serves as an urging means, is fitted over each column 24. The plate member 26 is mounted onto the respective columns 24 through the corresponding coil springs 25**.

As shown in FIG. 1, the plate member 26 is formed by bending an elongated thin plate at both widthwise edge portions at right angles along the length thereof; i.e., the plate member 26 includes a center plate **26*b* and two side plates 26*a*, 26*c* interposing the center plate 26*b*. The side plate 26*a* may be merely called the plate member in the description of the present invention. The center plate 26*b* of the plate member 26 has four holes at a predetermined interval. The columns 24 are inserted into the respective holes, so that the plate member 26 is supported by the coil springs 25. If a downwardly urging force is applied to the plate member 26, the plate member 26 receives an upwardly urging force by the resiliency of the coil springs 25. The center plate 26*b* and the columns 24 arranged on the structural body 9** serve as a support portion in the present invention.

Figure 4:
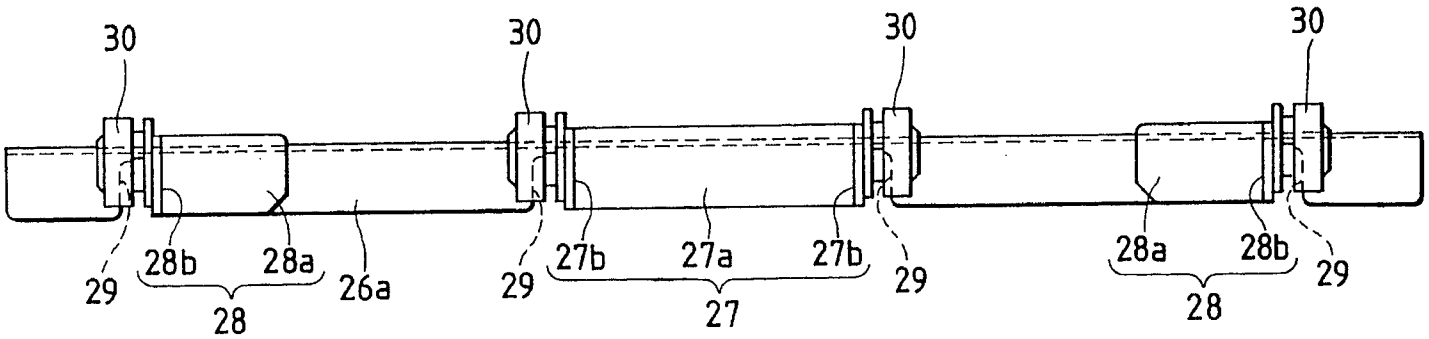
FIG. 4 shows lower second pulleys 30, a plate member 26, and support members as viewed in the direction indicated by the arrow B in FIG. 2.

As shown in FIGS. 4, 5, three support members 27, 28 are fixed to the side plate **26*a*. The support member 27 in the middle has a base portion 27*a* and two support portions 27*b*, 27*b* projecting frontward from both sides of the base portion 27*a*. Each of the two support members 28, 28 on both sides has a base portion 28*a* and a support portion 28*b* projecting frontward continuous to the base portion 28*a*. As shown in FIG. 4, the side plate 26***a* has four notches 29 in the front surface thereof. Two notches 29 are arranged on both sides of the support member 27 in the middle and two notches 29 outside the support members 28, 28 on both sides.

As shown in FIGS. 4, 5, second lower pulleys 30 are arranged one each to the respective support portion 27*b*, 28*b* of the support members 27, 28. The four second lower pulleys 30 are rotatably attached to the respective support portion 27*b*, 28*b* through independent rotary shafts. Although the rotary shafts of the four second lower pulleys 30 are independent of one another, the shaft lines thereof coincide with one another. The second lower pulleys 30 are in contact with the third upper pulleys 15 if nothing therebetween, respectively, and the respective coil springs 25 supporting the plate member 26 to which the second lower pulleys 30 are attached are in a pressed condition. Therefore, each second lower pulley 30 presses the corresponding third upper pulley 15 at a predetermined urging force by the resiliency of the corresponding coil spring 25. Further, each coil spring 25 also functions as causing the corresponding first lower pulley 22 to urge the corresponding second upper pulley 14.

The plate member 26 is made of a metal plate that has a predetermined resiliency against bending, and the side plates 26*a*, 26*c* are resiliently deformable with respect to the center plate 26*b* around the bending edges thereof. Further, as described above, the notch 29 is formed at each portion of the side plate 26*a* between the two adjacent support members 27 and 28. Therefore, the three support. members 27, 28 can be displaced independently of one another by recoverably deforming the portions of the side plate 26*a* defined by the respective notches 29 with respect to the center plate 26*b*. Hence, the four second lower pulleys 30 that are arranged on such support members 27, 28 can also move independently of one another. Since the two second lower pulleys 30, 30 in the middle are arranged on the common support member 27, the movements of both pulleys affect each other, but are not necessarily the same.

As shown in FIG. 5, the belts 31 are respectively installed around the first lower pulleys 22 and the second lower pulleys 30 whose positions in the axial direction correspond to each other. Each belt 31 moves endlessly across the plate member 26 and the corresponding notch 29. When the first lower rotary shaft 21 is driven, the first lower pulleys 22, the second lower pulleys 30, and the belts 31 rotate in the same direction. In FIG. 1, each of the pulleys 22, 30 and each belt 31 rotate in the counterclockwise direction.

Next to the feeding unit 5 is the stencil discharging container 6 that contains consumed stencil paper. The third upper pulleys 15 and the second lower pulleys 30 are arranged to face the entrance of the stencil discharging container 6.

The operation of the thus constructed rotary stencil printing machine at the time of discharging the consumed stencil paper will be described. Upon end of printing, the locking unit 3 is released. The leading end T of the perforated stencil paper for stencil printing wound around the cylindrical drum 2 is freed as shown by the one dot chain line in FIG. 1. The first feeding means 10 and the second feeding means 20 are driven, and the cylindrical drum 2 is rotated. The leading end of the stencil paper is introduced between the first feeding means 10 and the second-feeding means 20 while guided by the two separating pawls 23. When the leading end of the stencil paper has come in contact with the belts 17 between the first upper pulleys. 12 of the first feeding means 10 and the second upper pulleys 14 of the first feeding means 10, the leading end of the stencil paper is guided along the belts 17 to be introduced between the first feeding means 10 and the second feeding means 20. The stencil paper is forwarded towards the stencil discharging container 6 while nipped between the belts 16 of the first feeding means 10 and the belts 31 of the second feeding means 20.

The second lower pulleys 30 of the second feeding means 20 are supported by the support means 27, 28 so as to be movable independently of one another within a resilient deformable range. Further, each second lower pulley 30 is in contact with the corresponding third upper pulley 15 of the first feeding means 10 with a predetermined force. Even if the thickness of the stencil paper that is being forwarded becomes ununiform across the width, the four second lower pulleys 30 can be moved independently of one another by accommodating the fluctuations in the thickness of the stencil paper, which in turn allows the second lower pulleys 30 to nip the stencil paper at a uniform pressure together with the third upper pulleys 15 that confront the second lower pulleys 30. Therefore, the one-sided contact of the stencil paper with the belts 16, 31 can be prevented, which in turn allows the stencil paper to be forwarded correctly.

Figure 6:
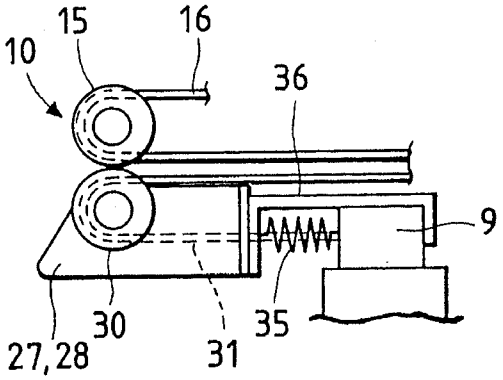
FIG. 6 is a partial view of a second embodiment of the invention.

FIG. 6 is a partial view of a second embodiment of the invention.

Parts that are not shown in the drawing are the same as those of the first embodiment. The second embodiment is distinguished from the first embodiment in the structure for supporting the second lower pulleys 30. A base end portion of a plate member 36 having bending resiliency is fixed to the structural body 9. The support members 27, 28 are fixed to the front end portion of the plate member 36 which serves as a free end. The second lower pulleys 30 are rotatably attached to the support members 27, 28. Between the front end portion of the plate member 36 and the structural body 9 are coil springs 35, each of which serves as an urging means. Each coil spring 35 urges the front end portion of the cantilevered plate member 36 upward, so that the second lower pulleys 30 urges the third upper pulleys 15 upward with a predetermined force. The second embodiment can provide the same operation and advantages as the first embodiment.

In the aforementioned embodiments, the second lower pulleys 30 are supported independently of one another with the plate members 26, 36 or the like that have bending resiliency, and the second lower pulleys 30 are brought into contact with the third upper pulleys 15 with the coil springs 25, 35. By supporting the other pulleys in a structure similar to that for the second lower pulleys 30, fluctuations in the thickness of the stencil paper that is being forwarded can be accommodated with further flexibility.

The aforementioned embodiments relate to the stencil paper feeding unit for the stencil discharging unit. However, the feeding unit of the invention is not applied only to the forwarding of the consumed stencil paper, but is, of course, applicable to sheetlike bodies to be forwarded including printing paper. In a printing paper feeding unit for a printing apparatus, in particular, one may, in some cases, encounter inconveniences such as the diverting of the sheet forward direction with a one-sided forwarding force applied to a sheet or the jamming of the sheet along a forwarding path when the sheet that is narrower than the width of the feeding unit is to be forwarded. According to the feeding unit of the invention, the sheet can be forwarded correctly even if such sheet whose width is smaller than that of the forward unit is forwarded.

According to the feeding unit of the invention, a work to be forwarded can be forwarded correctly even if the thickness of the work to be forwarded becomes ununiform across the width, which in turn contributes to avoiding such inconvenience as jamming the work to be forwarded along a forwarding path.

What is claimed is:

1. A feeding unit comprising:

first feeding means including, a plurality of pulleys arranged to confront one another, each having an axis and being rotatable around said axis, and a belt installed around said pulleys, wherein a set is defined by said pulleys and said belt therearound, and a plurality of sets are provided and juxtaposed along pulley's axial directions;

second feeding means including, a plurality of pulleys arranged to confront one another, each having an axis and being rotatable around said axis, and a belt installed around said pulleys, wherein a set is defined by said pulleys and said belt therearound, a plurality of sets are provided and juxtaposed along pulley's axial directions, said pulleys of said second feeding means are located at the corresponding position to said respective pulleys of said first feeding means; and support means for urging the respective pulleys belonging to at least a single pulley group, the single pulley group being defined by said pulleys arranged along a common axis in either one of said first feeding means and said second feeding means, toward confronting the other one of said first feeding means and said second feeding means with a predetermined force independently from the other pulleys belonging to the same single pulley group.

2. A feeding unit according to claim 1, wherein said support means includes:

a plurality of support members for rotatably supporting a plurality of pulleys arranged along one of common axis;

a plate member to which said support members are attached, said plate member having bending resiliency;

a support portion for supporting said plate member so as to keep the bending resiliency of said plate member; and urging means for urging said plate member wherein said pulleys arranged along said one of the common axis come in contact with said corresponding pulleys belonging to the confronting feeding means.

3. A feeding unit according to claim 2, wherein a notch is formed at least one of positions, each position being between mounting portions of said support members.

4. A feeding unit for feeding a work, comprising:

a first-pulley shaft;

first pulleys secured on said first-pulley shaft;

second pulleys having a common axis paralleling said first-pulley shaft, said second pulleys being positioned downstream with respect to said first pulleys;

mounting members on which said respective second pulleys are rotatably mounted;

belts installed between said respective first pulleys and said respective second pulleys;

a third-pulley shaft paralleling said first-pulley shaft, said third-pulley shaft positioned the opposite side to said first-pulley shaft with respect to the work;

third pulleys secured on said third-pulley shaft, said third pulleys being confronting said respective first pulleys;

fourth pulleys having a common axis paralleling said third-pulley shaft, said fourth pulleys being positioned downstream with respect to said third pulleys and being confronting said respective second pulleys;

belts installed between said respective third pulleys and said respective fourth pulleys; and a support member on which said fourth pulleys are rotatably mounted, wherein said support member individually urges said fourth pulleys toward said second pulleys.

5. A feeding unit according to claim 4, wherein said support member includes:

fourth-pulley support members rotatably supporting said respective fourth pulleys;

a plate member to which said fourth-pulley support members are attached, said plate member having bending resiliency;

a support portion supporting said plate member with keeping the bending resiliency of said plate member; and a spring urging said plate member.

6. A feeding unit according to claim 5, wherein said plate member has a notch between positions where said forth-pulley support members are attached.

7. A feeding unit according to claim 5, wherein each of said fourth-pulley support members is movable individually from the other fourth-pulley support members by deforming said plate member.

8. A feeding unit according to claim 5, wherein said plate member and said support portion are made of a metal plate.

9. A feeding unit according to claim 5, wherein said fourth-pulley support members are attached to extend from said plate member toward downstream.

10. A feeding unit according to claim 5, wherein said support member further includes a column under said support portion, and said spring of said support member is a coil spring wound around said column.

* * * * *